US012540450B2

(12) United States Patent
Zhdanov et al.

(10) Patent No.: US 12,540,450 B2
(45) Date of Patent: Feb. 3, 2026

(54) METHOD FOR AUTOMATICALLY CONTROLLING CYCLICAL OPERATIONS OF AN EARTHMOVING MACHINE

(71) Applicant: Topcon Positioning Systems, Inc., Livermore, CA (US)

(72) Inventors: Alexey Vladislavovich Zhdanov, Moscow (RU); Alexey Andreevich Kosarev, Moscow (RU); Andrey Nikolayevich Zabegaev, Korolyov (RU)

(73) Assignee: Topcon Positioning Systems, Inc., Livermore, CA (US)

( * ) Notice: Subject to any disclaimer, the term of this patent is extended or adjusted under 35 U.S.C. 154(b) by 879 days.

(21) Appl. No.: 17/594,064

(22) PCT Filed: Mar. 5, 2021

(86) PCT No.: PCT/RU2021/000095
§ 371 (c)(1),
(2) Date: Sep. 30, 2021

(87) PCT Pub. No.: WO2022/186715
PCT Pub. Date: Sep. 9, 2022

(65) Prior Publication Data

US 2022/0298743 A1 Sep. 22, 2022

(51) Int. Cl.
*E02F 3/43* (2006.01)

(52) U.S. Cl.
CPC ..... *E02F 3/437* (2013.01); *E02F 3/434* (2013.01)

(58) Field of Classification Search
CPC ..... E02F 3/437; E02F 3/434; E02F 3/439
See application file for complete search history.

(56) References Cited

U.S. PATENT DOCUMENTS 5,493,798 A * 2/1996 Rocke ..... E02F 3/437 701/50
9,464,410 B2 * 10/2016 Johnson ..... E02F 3/434
(Continued)

FOREIGN PATENT DOCUMENTS

CN 103562006 A 2/2014
CN 107740448 A 2/2018
(Continued)

OTHER PUBLICATIONS

International Search Report and Written Opinion mailed Nov. 18, 2021, in connection with International Patent Application No. PCT/RU2021/000095, filed Mar. 5, 2021, 9 pgs.
(Continued)

*Primary Examiner* — Scott A Browne
*Assistant Examiner* — Lidia Kwiatkowska
(74) *Attorney, Agent, or Firm* — Chiesa Shahinian & Giantomasi PC

(57) ABSTRACT

An earthmoving machine and method for automatically controlling cyclical operations of the earthmoving machine are disclosed. The earthmoving machine includes a plurality of machine elements each controlled by one or more respective actuators. the method comprises: determining a current machine state; calculating control signals for at least one actuator when the current machine state corresponds to a cyclical operation; and transmitting the control signals to the at least one actuator to automatically control the cyclical operation.

29 Claims, 10 Drawing Sheets

(56) References Cited

U.S. PATENT DOCUMENTS

| | | | | |
|---|---|---|---|---|
| 2012/0293316 | A1 | 11/2012 | Johnson et al. | |
| 2018/0245317 | A1 | 8/2018 | Ready-Campbell et al. | |
| 2020/0362530 | A1 | 11/2020 | Seki et al. | |
| 2021/0002851 | A1* | 1/2021 | Morita | E02F 3/439 |
| 2021/0165414 | A1 | 6/2021 | Aizawa et al. | |
| 2021/0246625 | A1* | 8/2021 | Oi | E02F 9/265 |
| 2021/0262190 | A1* | 8/2021 | Ito | E02F 3/437 |
| 2022/0002970 | A1* | 1/2022 | Kurosawa | E02F 3/437 |
| 2022/0186461 | A1 | 6/2022 | Konda et al. | |
| 2023/0332377 | A1* | 10/2023 | Sato | E02F 9/262 |

FOREIGN PATENT DOCUMENTS

| | | | | |
|---|---|---|---|---|
| CN | 111954737 | A | 11/2020 | |
| CN | 113039326 | A | 6/2021 | |
| CN | 113661295 | A | 11/2021 | |
| EP | 3770333 | A1 | 1/2021 | |
| JP | H0849265 | A | 2/1996 | |
| JP | H11286967 | A | 10/1999 | |
| JP | 2019178598 | A | 10/2019 | |
| JP | 2020060032 | A | 4/2020 | |
| JP | 2020204193 | A | 12/2020 | |
| RU | 2232234 | C2 | 7/2004 | |
| RU | 136055 | U1 | 12/2013 | |
| RU | 2526437 | C1 | 8/2014 | |
| SU | 1112100 | A1 | 9/1984 | |
| WO | WO-2018136889 | A1 * | 7/2018 | E02F 3/32 |
| WO | 2020196895 | A1 | 10/2020 | |
| WO | 2019181872 | A1 | 3/2021 | |

OTHER PUBLICATIONS

Extended European Search Report mailed Dec. 5, 2024 in connection with European Patent Appliation No. 21929330.5, filed Oct. 3, 2023, 6 pgs.

Notice of Reasons for Refusal mailed Dec. 24, 2024 in connection with Japanese Patent Application No. 2023-553605, 14 pgs. (including translation).

Office Action mailed Nov. 6, 2025, in connection with Chinese Patent Application No. 2021800950996, filed Sep. 1, 2023, 26 pgs. (including translation).

* cited by examiner

METHOD FOR AUTOMATICALLY CONTROLLING CYCLICAL OPERATIONS OF AN EARTHMOVING MACHINE

TECHNICAL FIELD

The present disclosure relates generally to a method of controlling an earthmoving machine and more particularly to controlling cyclical operations of an earthmoving machine.

BACKGROUND

An excavator is an earthmoving machine widely used for construction, mining, offshore digging, and similar types of applications. It can be used for digging ground, backfilling, grading surfaces, forming slopes, moving material from one point to another, loading material onto dump trucks, and so on. Other available types of earthmoving machines are generally more specialized. For example, a dozer and a motor-grader are designed for grading, while a frontal loader is used for loading. Because excavators are more widely distributed, it is desirable to use an excavator in the most efficient way to improve overall construction site performance.

An excavator consists of a bucket, stick, boom, and rotating body platform with a cab. The platform is placed on an undercarriage with tracks or wheels. The bucket, stick, boom, and platform are pivotally connected to each other and are operated with the help of hydraulic cylinders. The platform and undercarriage may be connected to each other via a ring bearing and the platform is rotated by a hydraulic motor. The hydraulic cylinders are controlled by an operator sitting in the cab, e.g., using a valve block having two left and right joysticks. Two pedals or arms allow the operator to control the tracks or wheels to rotate the platform or move it forward or backward. A popular type of excavator used for construction applications includes a back digger for digging with a bucket movement directed toward the platform, i.e., from front to back. The bucket may include a cutting edge directed toward an inside face.

Each joystick in the cab has four degrees of freedom: left, right, forward, and backward. Thus, two joysticks allow for eight degrees of freedom to fully control the bucket, stick, boom, and platform. The operator can shift the joystick grips to dig ground, typically with the help of the bucket and the stick, and then carry the dug material by lifting the boom and rotating the platform. After the material is dumped, the operator returns all excavator elements back to the approximate initial digging point to dig new ground and move the material again. This is often a cyclical procedure that includes periodically repeating the same or similar operations over a period of time. A typical cycle time for an excavator to perform this cyclical procedure is approximately 15 seconds.

The quick and coordinated manipulation of the controlling joysticks is the key to efficient use of the excavator. Only experienced operators are capable of using the machine to produce maximum productivity and maintain the cycle time close to the 15 second duration. To achieve an efficient cycle, operators must simultaneously move the bucket and stick at digging, and use the shortest distance to move the material to a dump pile while simultaneously manipulating the boom and platform. The operator should simultaneously operate each of the bucket, stick, boom, and rotating cab during a dumping stage. Similar simultaneous operations are required for efficiently returning the bucket back to the digging start point.

However, even experienced operators are not able to maintain the ideal cycle time throughout the working day due to a number of variables, including fatigue, uncomfortable ambient temperature, breathing air quality, noise, vibration, bad visibility, e.g., due to direct sunlight, night, dust, fog, snow, rain, and muddy windows, and so on.

A solution for the efficient operation of an excavator is an automatic control system with minimal dependency on human input. Current systems on the market allow for automatic control of a boom height and bucket cutting angle for final grading operations. Such machines must be equipped with absolute position sensors, such as GPS sensors or lasers, as well as sensors configured to measure the orientation of various excavator parts. These include cylinder encoder/stroke sensors or inertial measurement units (IMUs) to measure acceleration and angular rate. Some current systems include a digital terrain model that represents a target design of a ground surface for grading. Sensor chains allow for calculation of absolute bucket positions and attitudes. The system then compares a current position and attitude with target positions and attitude, and commands electrohydraulic valves to move the boom and bucket to achieve desired positions. However, such systems do not teach automated stick control and platform rotation. The average duty cycle is very low, with almost no positive impact on cycle time except very for short time intervals during the final grading, which is the last stage of a project after the time intensive digging operation has been completed.

To better achieve efficiency, a more advanced automatic system with a high duty cycle is desired in which all of the excavator parts are automatically controlled, not only the boom and bucket. This requires programming all of the stages of a workflow. However, formalization of a workflow is a challenging task due to various unknowns relating to the local ground environment. These unknowns can include soil density, looseness, traction, clay adherence to the bucket, and hidden objects buried underground, each of which are difficult to predict or control.

Current systems rely on a human operator for a number of variables, including where and what attitude the machine should be placed at relative to the working environment; a digging strategy, including an initial digging start point and dump point to avoid looseness in the dump pile; avoiding underground communication cables and detecting a bucket reaction in case of contact with underground objects; avoiding ground obstacles and power lines; cleaning the bucket from accumulated clay; heavy and rocky material processing; where and how to perform backfilling; how to efficiently compact ground material; and how to move a machine to perform subsequent steps, e.g., during a terrace operation. Additionally, the sensors necessary for properly monitoring all necessary environmental variables are often expensive (e.g., LIDAR and radar sensors), insufficiently robust for a working environment, or unreliable.

BRIEF SUMMARY OF THE INVENTION

What is needed is the ability to automate the routine operations of an earthmoving machine, such as an excavator, using a simple sensor block, while allowing for an operator to manually perform remaining complex tasks. The present disclosure therefore provides assistance to an operator for the cyclical tasks while allowing a manual override, thus minimizing time cycle, avoiding operator fatigue, and allowing maximum efficient machine operation.

In accordance with one or more embodiments, systems and methods for controlling cyclical operations of the earthmoving machine are provided.

One embodiment includes a method for automatically controlling cyclical operations of an earthmoving machine comprising a plurality of machine elements each controlled by one or more respective actuators. The method includes determining a current machine state; calculating control signals for at least one actuator when the current machine state corresponds to a cyclical operation; and transmitting the control signals to the at least one actuator to automatically control the cyclical operation.

A further embodiment includes an apparatus and a method for automatically controlling cyclical operations of an earthmoving machine comprising a plurality of machine elements each controlled by one or more respective actuators. The method includes updating a current machine state based on a current machine position; recording a path of the earthmoving machine during a cyclical operation; determining a target based on the recorded path and the current machine state; and calculating control signals for at least one actuator based on the target and recorded path.

In yet a further embodiment, the present disclosure includes an earthmoving machine, including a plurality of machine elements; one or more actuators configured to control each of the plurality of machine elements; one or more sensors configured to detect a position and velocity of each of the plurality of machine elements; and a controller in communication with the one or more sensors and the one or more actuators, wherein the controller is configured to automatically control cyclical operations of the earthmoving machine by transmitting control signals to the actuators based on input from the sensors.

These and other advantages of the disclosure will be apparent to those of ordinary skill in the art by reference to the following detailed description and the accompanying drawings.

DETAILED DESCRIPTION

In general, embodiments of the present disclosure described herein can be used for controlling systems of earthmoving machines that perform repeatable operations during a work cycle. Examples of such earthmoving machines include excavators, front loaders, backhoe loaders, skid-steer loaders, and the like. In the description below, a hydraulic excavator is used as a nonlimiting example of an earthmoving machine for which embodiments of the disclosure can be used.

Figure 1A:
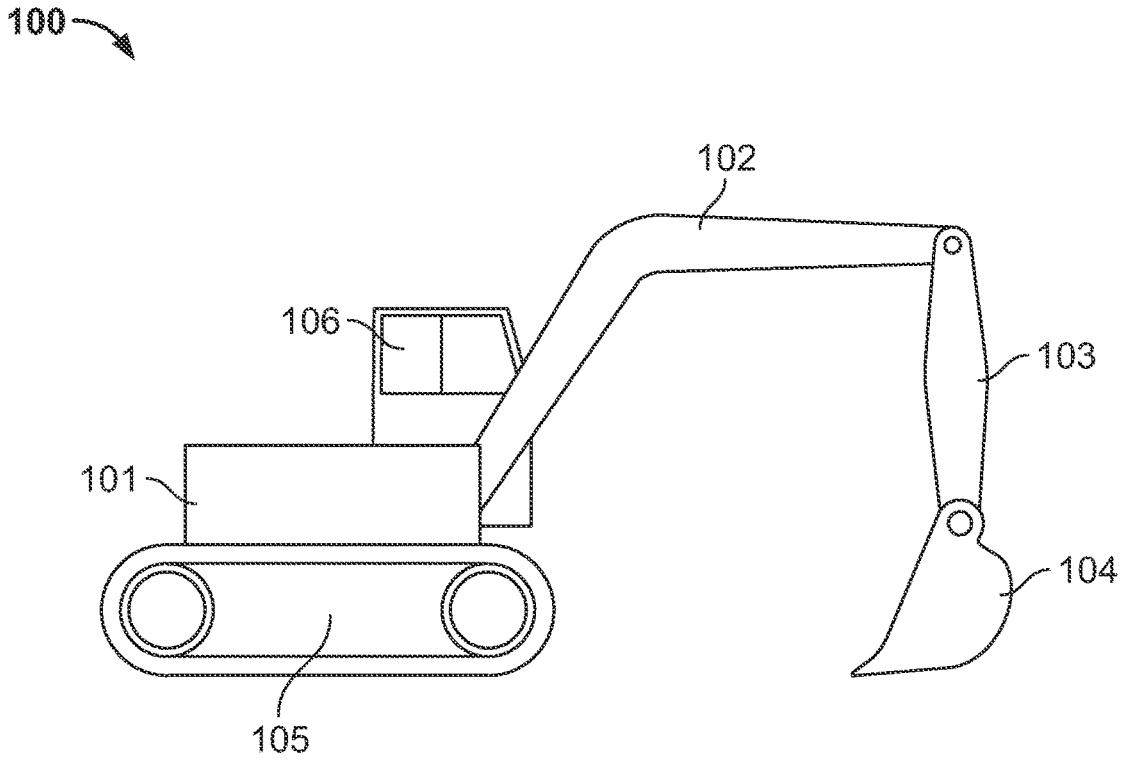
FIGS. 1A-1D are schematic diagrams of an excavator.
Figure 1B:
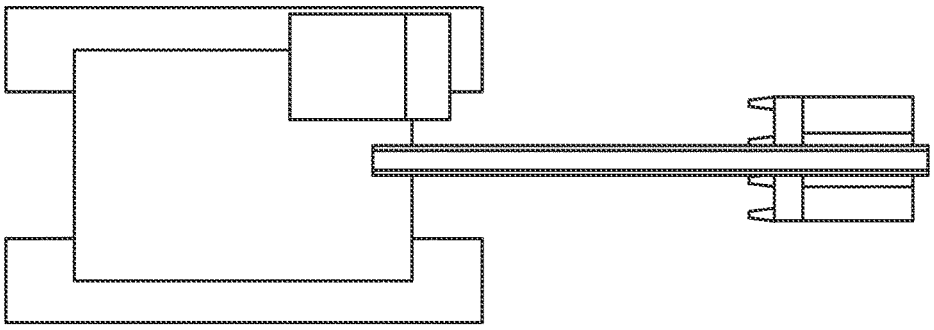

FIGS. 1A-1D are schematic diagrams of an excavator 100. FIG. 1A shows the excavator elements, including body 101 with cab 106, boom 102, stick 103, bucket 104, and track system 105. FIG. 1B is a plan view of the excavator 100. Body 101 can be operably rotated around vertical axis of track system 105 by means of a body actuator. An example of a body actuator is a hydraulic motor. Boom 102, stick 103, and bucket 104 can be operably rotated around their joints by means of actuators. An example of such actuators includes hydraulic cylinders.

In some embodiments, addition connections among the excavator 100 components exist, e.g., to offer additional rotational or transfer degrees of freedom. For example, a boom can contain two or more parts pivotally connected to each other. As another example, a bucket can have two or more rotational degrees of freedom.

During a typical work cycle of operation, an excavator performs operations including digging, lifting, carry, dumping, and returning to a digging start position. A system described herein can automatically perform certain excavator working cycle operations, particularly the carrying, dumping, and returning operations. A system described herein is configured to duplicate paths produced by the excavator elements during a working cycle operation.

Figure 1C:
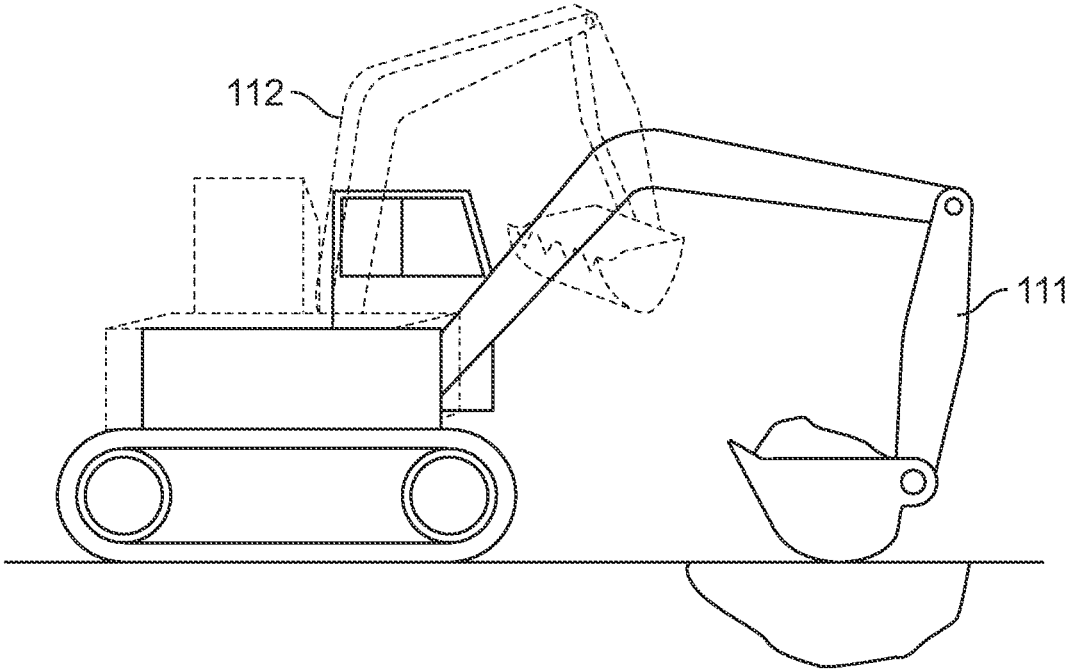
Figure 1D:
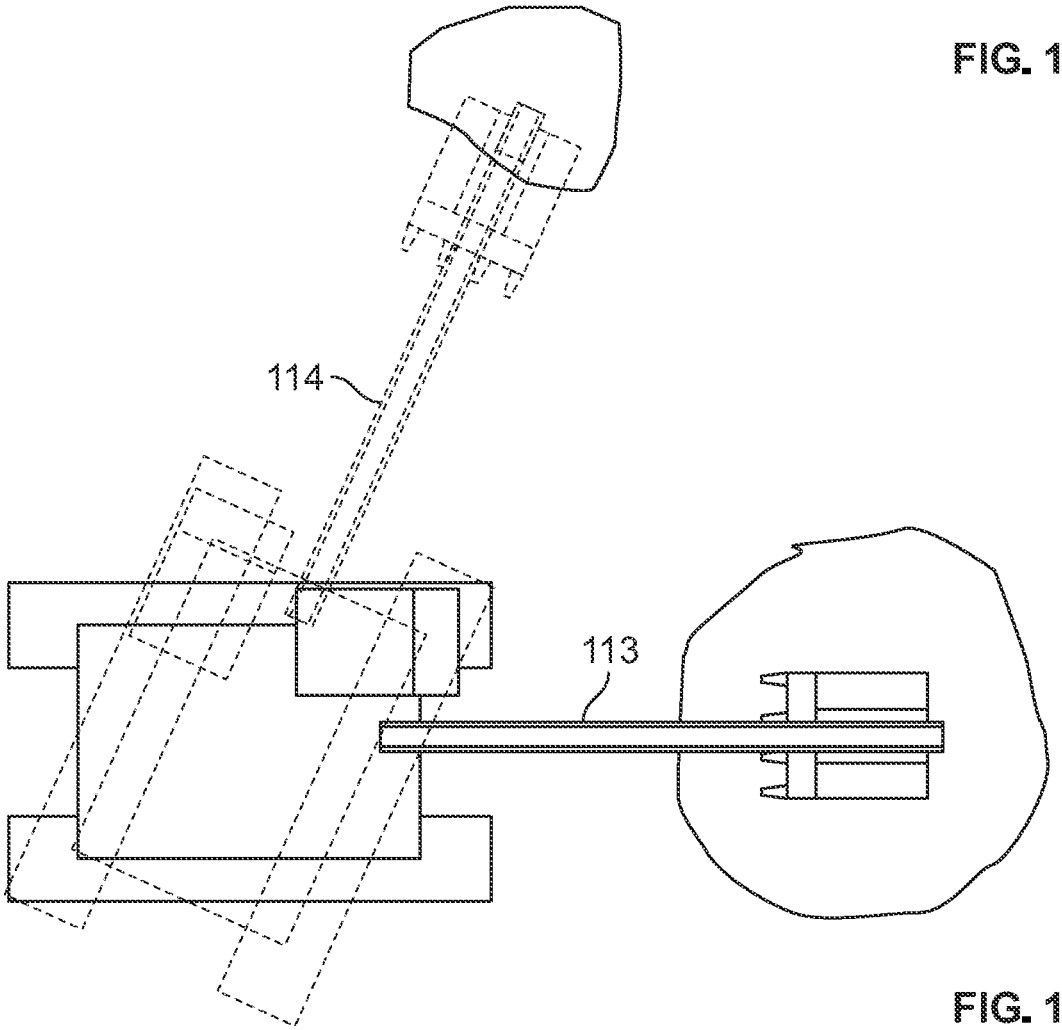

FIGS. 1C and 1D show an exemplary side and plan view, respectively, of the excavator in a lifting and a dumping start position. Side view of lifting position 111 is drawn in solid lines and side view of dumping start position 112 is drawn in dashed lines. Plan view of lifting position 113 is drawn in solid lines, and plan view of dumping start position 114 is drawn in dashed lines.

Figure 2:
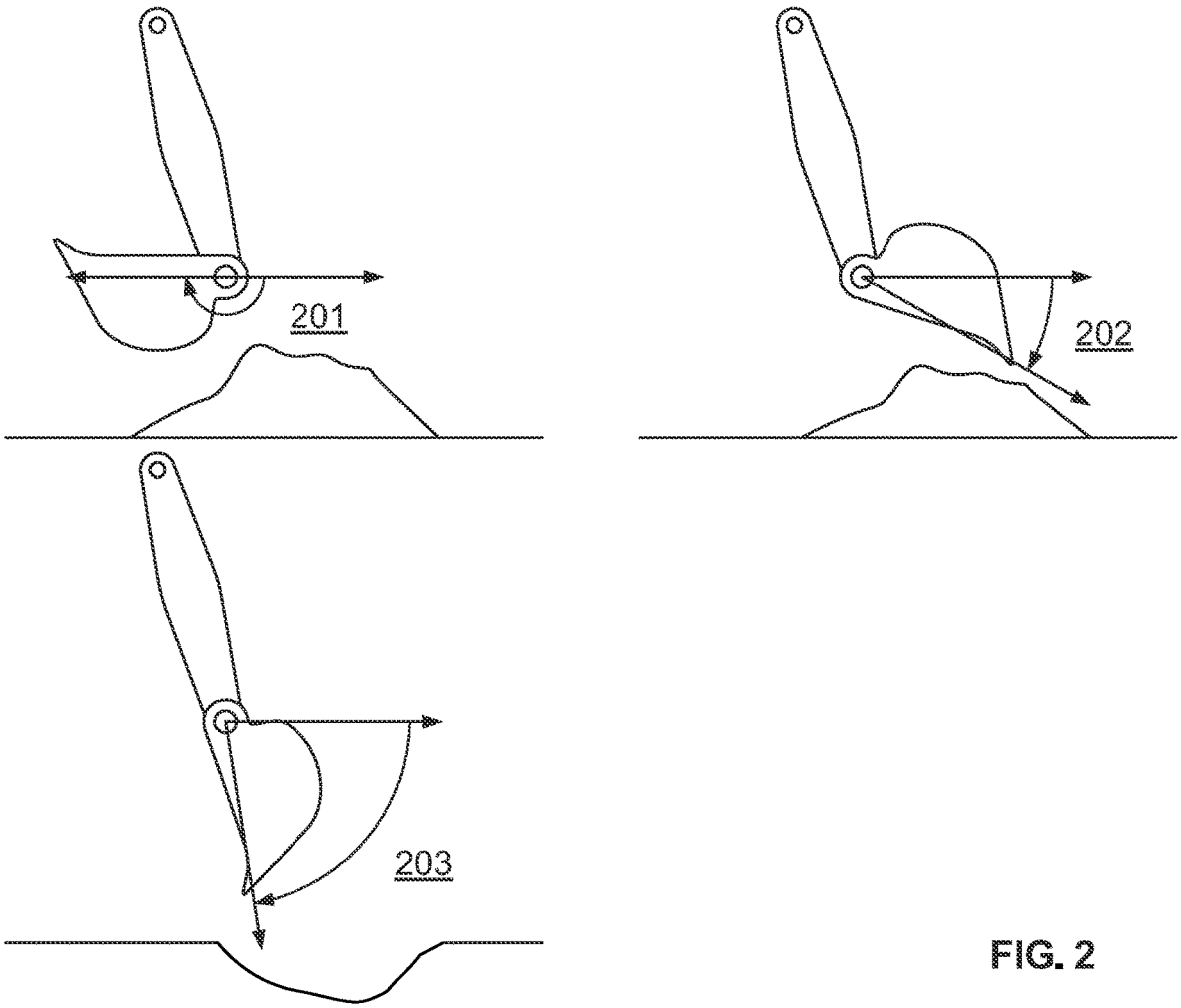
FIG. 2 is a schematic diagram of a side view of a bucket in a dumping start position, a dumping end position, and a digging start position, with corresponding bucket angles.

FIG. 2 includes side views of an excavator bucket in dumping start position 201, dumping end position 202 and digging start position 203, with corresponding bucket angles.

Figure 3:
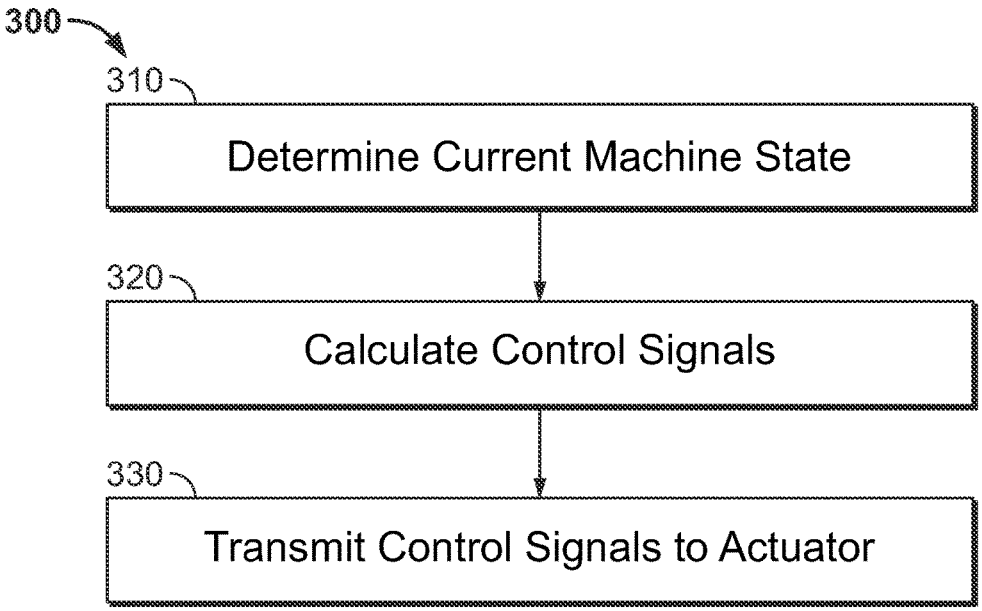
FIG. 3 is a flowchart of a control algorithm according to an embodiment.

FIG. 3 is a flowchart 300 of a control algorithm according to an embodiment.

At step 310, a current machine state is determined. The current machine state includes controller states of an excavator, such as digging, carrying, dumping, and returning. In a further embodiment, the current machine state includes a current machine state vector comprising position and velocity information relating to the elements of the excavator.

At step 320, control signals for the excavator elements are calculated based on the determined current machine state. The control signals include instructions that direct the elements of the excavator to execute functions and movements in order to perform operations corresponding to certain controller states, e.g., carrying, dumping, and returning.

At step 330, the calculated control signals are transmitted to one or more actuators that are configured to control the excavator elements to perform the desired operations.

Figure 4:
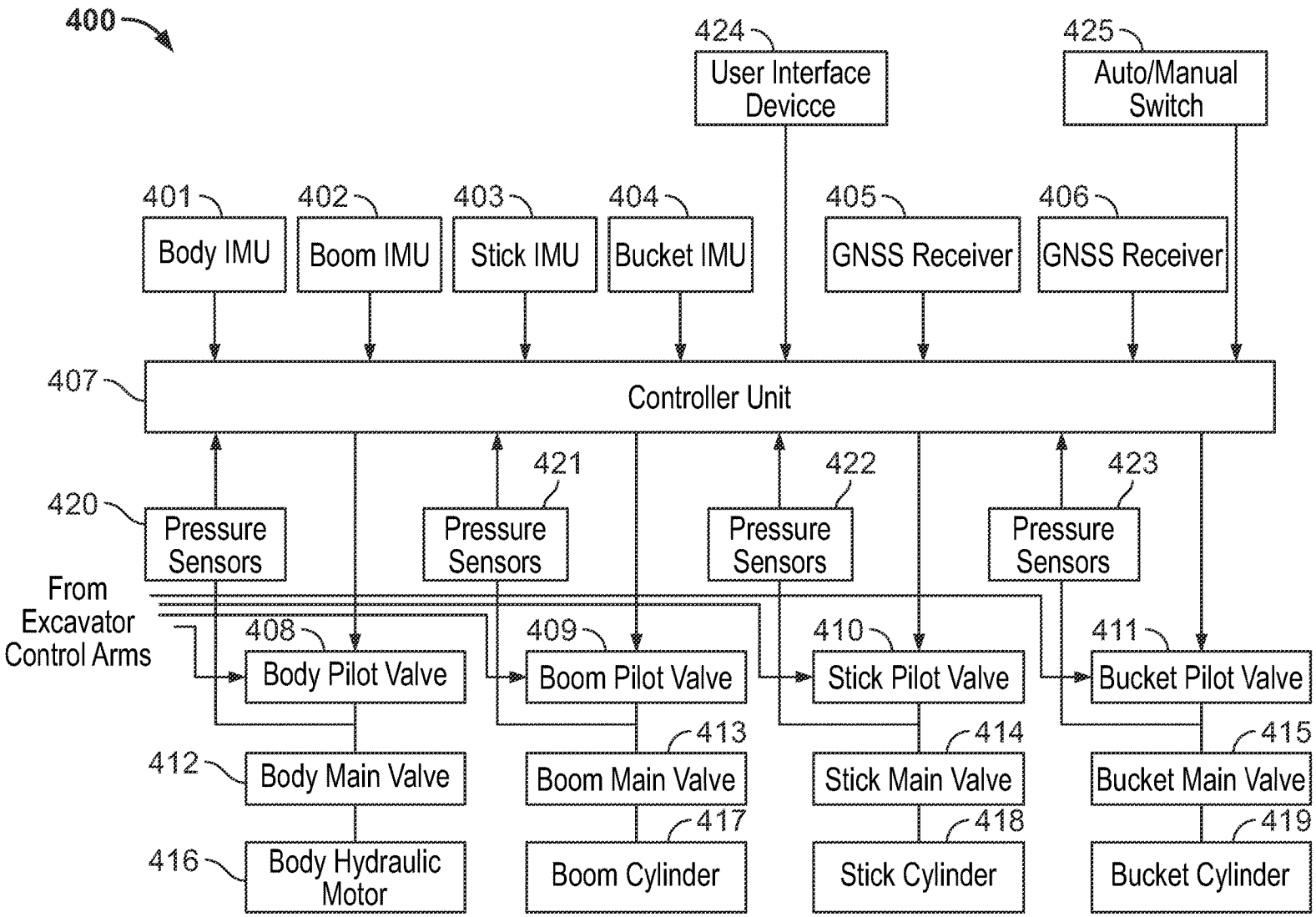
FIG. 4 is a schematic diagram of a control system of an earthmoving machine according to an embodiment.

FIG. 4 is a schematic diagram of an embodiment of a control system 400 of an earthmoving machine according to an embodiment. Measurement units are installed on the body, boom, stick and bucket of an excavator. Examples of measurement units include GNSS receivers, laser sensors, accelerometers, gyroscopes, magnetic sensors, rotation sensors, linear displacement sensors, and the like. In an embodiment, GNSS receivers 405, 406 are mounted on one or more elements of an excavator, and combinations of accelerometers and gyroscopes, e.g., body inertial measurement units (IMU) 401, boom IMU 402, stick IMU 403, and bucket IMU 404, are mounted on the body, boom, stick, and bucket of the excavator, respectively.

The measurement units 401-406 are in communication with a controller unit 407. An example of a controller unit 407 is computer system, comprising a processor, a memory and an input/output subsystem. Another example of a controller unit 407 includes a microcontroller device integrated within a measurement unit, for example in GNSS receiver 405.

Controller unit 407 is further connected to body, boom, stick, and bucket actuators. An example of an actuator is an electrically controlled hydraulic valve connected to analog output of a controller device. Another example of an actuator is a digitally controlled hydraulic valve connected to controller device via a communication network.

In an embodiment of the present disclosure, body pilot hydraulic valve 408, boom pilot hydraulic valve 409, stick pilot hydraulic valve 410, and bucket pilot hydraulic valve 411 for each of the excavator elements of the body, boom, stick, and bucket, respectively, are each connected to a corresponding pilot hydraulic line (not shown). Control signals from controller unit 407 control the pressure of hydraulic fluid passing through a pilot hydraulic valve, which in turn controls the amount of hydraulic fluid, or flow, passing through each of the body main hydraulic valve 412, boom main hydraulic valve 413, stick main hydraulic valve 414, and bucket main hydraulic valve 415. The hydraulic liquid passing through the main hydraulic valves adjusts the body hydraulic motor 416 velocity, boom hydraulic cylinder 417, stick hydraulic cylinder 418, or bucket hydraulic cylinder 419, and consequently changes the position of the body, boom, stick or bucket. In another embodiment, main hydraulic valves are connected directly to main hydraulic lines.

In an embodiment, pressure sensors 420, 421, 422, 423 for each of the excavator elements are connected to the pilot hydraulic lines. Pilot hydraulic line pressure sensors measure the pressure caused by operator manual control with the excavator control arms. Output signals from these sensors are communicated to controller unit 407. In another embodiment, pressure sensors 420, 421, 422, 423 are connected directly to the main hydraulic lines.

In some embodiments, additional devices are placed in the operator cab of the excavator, such as a user interface device 424 or an auto/manual switch 425, which are in communication with the controller unit 407. An example of a user interface device is display device with touch screen.

Figure 5:
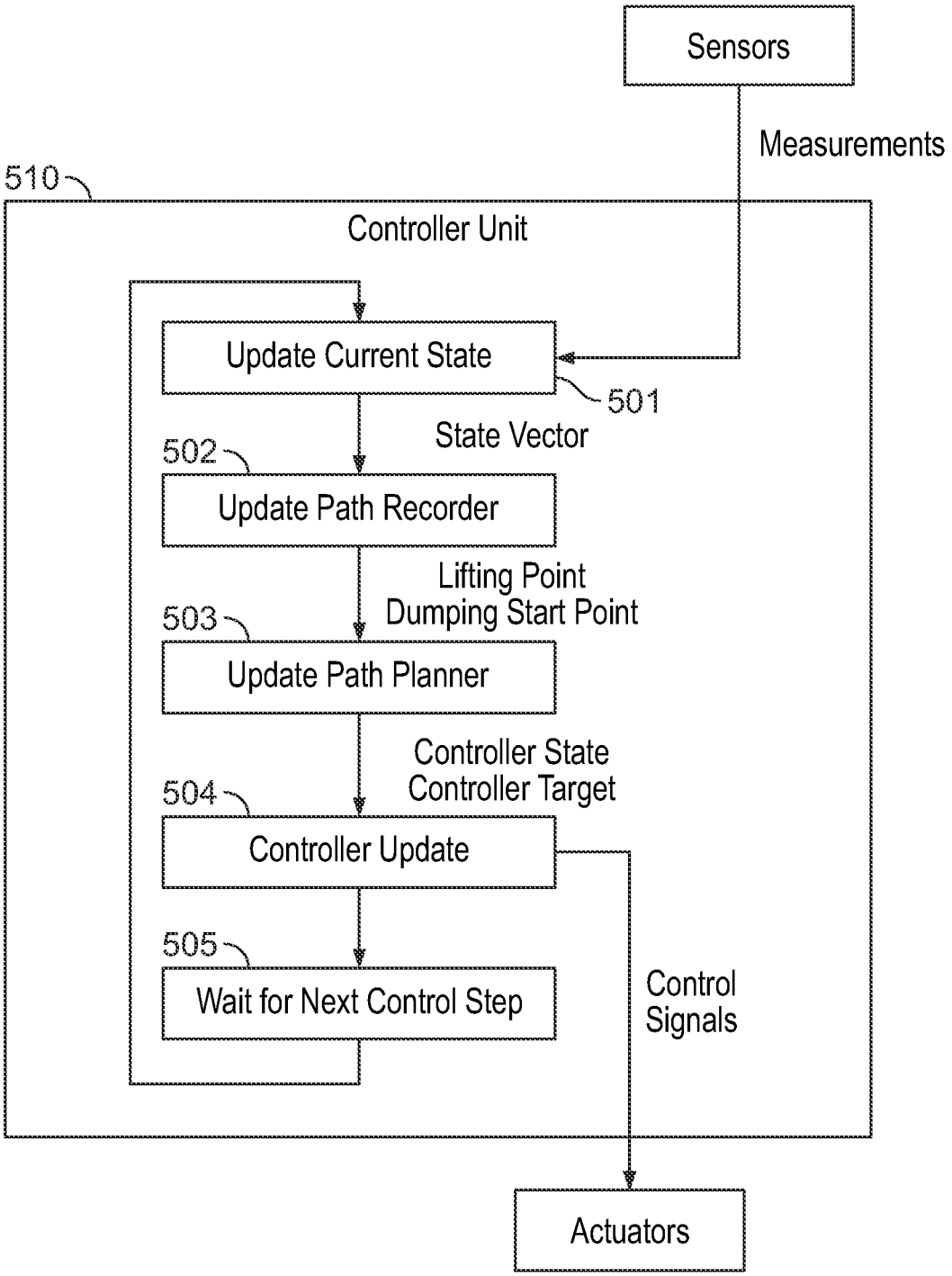
FIG. 5 is a schematic diagram of a control algorithm according to an embodiment.

FIG. 5 is a schematic diagram of a control algorithm according to an embodiment. At each discrete time epoch, controller unit 510, which in an embodiment is controller unit 407 of FIG. 4, executes the control algorithm. In an embodiment, the control algorithm comprises the following steps: updating an excavator current state 501, updating a path recorder 502, updating a path planner 503, updating the controller 504, and waiting for the next control step 505, after which the algorithm returns to step 501. In an embodiment, the algorithm is performed during a single time epoch. A time epoch is a predetermined period of time during which the control algorithm is performed, e.g., 1 millisecond.

Updating the excavator current state 501, or current machine state, is the first step of the control algorithm that is executed during each discrete time epoch. Controller unit 510 receives measurements from the excavator, e.g., from measurement units 401-406 of FIG. 4, and updates an estimation of an excavator state vector. In an embodiment of the present disclosure, a state vector comprises at least a position and a velocity of a body in a coordinate system connected to Earth, and includes an angular attitude and an angular velocity of each of the body, boom, stick, and bucket. In another embodiment, the state vector includes the position and velocity of a predefined point on each of the body, boom, stick, and bucket. Using known kinematics and geometry of an excavator, the state vector can be transformed from an angular position to a linear position and vice versa. In yet another embodiment, the positions and velocities, or the angular attitude and angular velocities, of each of the body, boom, stick, and bucket are calculated in a coordinate system connected to an excavator track system. Using known kinematics and geometry of an excavator and the position of the excavator tracks in a coordinate system connected to Earth, the state vector can be transformed from a coordinate system connected to the tracks to a coordinate system connected to the Earth and vice versa.

Updating the path recorder 502 is the second step of the control algorithm executed at each discrete time epoch. In an embodiment, the excavator state vector, calculated at excavator state update step 501 of the control algorithm, is an input for updating the path recorder. In another embodiment, a signal from a user interface device is another input for path recorder update. Examples of such a signal are a button press event, or a touch screen touch event. In yet another embodiment, measurements from pressure sensors 420, 421, 422, 423, connected to pilot hydraulic lines, are another input for path recorder update.

The excavator state vector and other inputs are used to determine if the current excavator state corresponds to a dumping start position or a lifting position. If the current excavator state corresponds to a dumping start position, a dumping start point is updated. Example of such an updating is copying contents of the excavator state vector to a memory area in the controller unit containing a dumping start point state vector and setting a flag, indicating that a dumping start point was updated. If the current excavator state corresponds to a lifting position, a lifting point is similarly updated.

Figure 6:
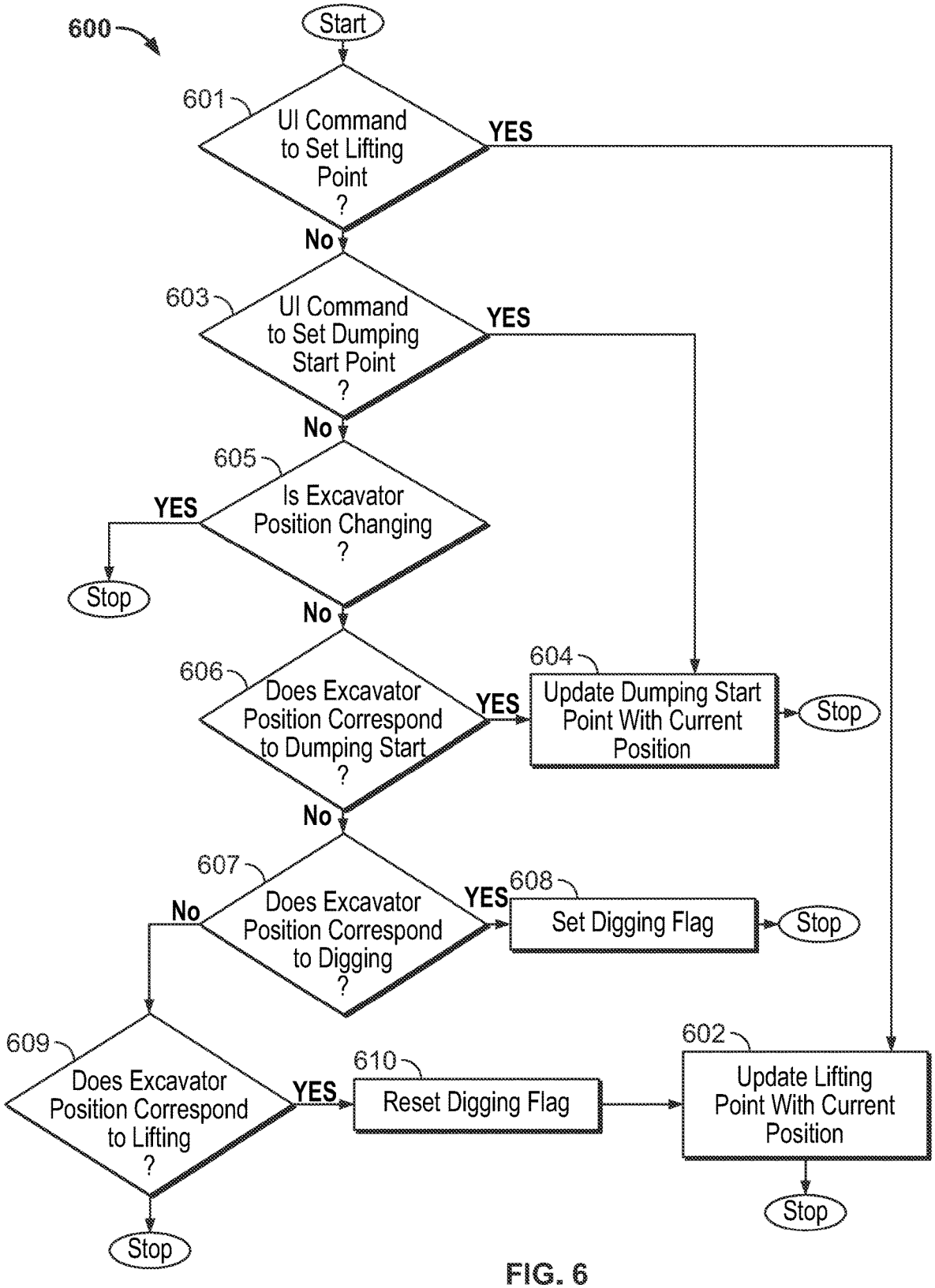
FIG. 6 is a flowchart of a path recorder update algorithm according to an embodiment.

FIG. 6 is a flowchart of a path recorder update algorithm 600. To determine if the current excavator state corresponds to a dumping start position or a lifting position, a method including the following steps is performed.

In an embodiment of the present disclosure, the system can be commanded to set a lifting point at step 601, e.g., from a user interface device, and the lifting point is updated with the current position at step 602. If the system is commanded from user interface device to set a dumping start point at step 603, the dumping start point is updated with the current position at step 604. In another embodiment, a dumping start point is calculated from an excavator position, which is estimated by measurement units installed on the excavator, for example GNSS receivers, and transmitted to the controller unit 510. In yet another embodiment, the excavator position estimation can be calculated by sensors installed on the excavator, such as radars, laser sensors, video cameras, and sonic sensors.

At step 605, a check is performed to determine if an excavator position is changing or not changing. For example, if an absolute value of vector differences between a current state vector and a state vector from a previous time epoch is lower than a predefined threshold, and this condition is satisfied for a predefined number of time epochs, it is determined that an excavator position is not changing. If the excavator position is changing, a return from path recorder update without updating any points is performed.

At step 606, components of the state vector are compared with predefined thresholds to determine if the current state vector corresponds to a dumping start position. Examples of such components are bucket angle, stick to bucket joint height, body heading, and body angular velocity. In an embodiment of the present disclosure, if the bucket angle is greater than a predefined threshold, the stick to bucket joint height is greater than a predefined threshold, the absolute value of a body angular velocity is lower than a predefined threshold, lifting point was set, or the absolute value of the difference between a current body heading and lifting point body heading is greater than a predefined threshold, a dumping start point is updated at step 604.

At step 607, whether the current excavator state vector corresponds to a lifting position is determined. In an embodiment, if a stick to bucket joint height is lower than a predefined threshold, a digging flag is set at step 608. Otherwise, at step 609, if stick to bucket joint height is greater than a predefined threshold a digging flag is set, a lifting point is updated with the current state vector at step 602, and a digging flag is reset at step 610.

In an embodiment, if the excavator track position is determined to have changed, a lifting point and dumping start point state vectors are recalculated so that the geometry of the positions of the lifting point and dumping start point in a coordinate system connected to Earth remain unchanged.

Returning back to FIG. 5, at step 503 a path planner is updated. In an embodiment, the path planner is updated at each discrete time epoch. In an embodiment, the excavator state vector, calculated at step 501, is an input for the path planner update, and the lifting and dumping start points updated at step 502 is another input of path planner update.

During the path planner update, the excavator state vector, lifting point, and dumping start point are used to determine a target position such that a transition between controller states and excavator control are produced automatically.

Figure 7:
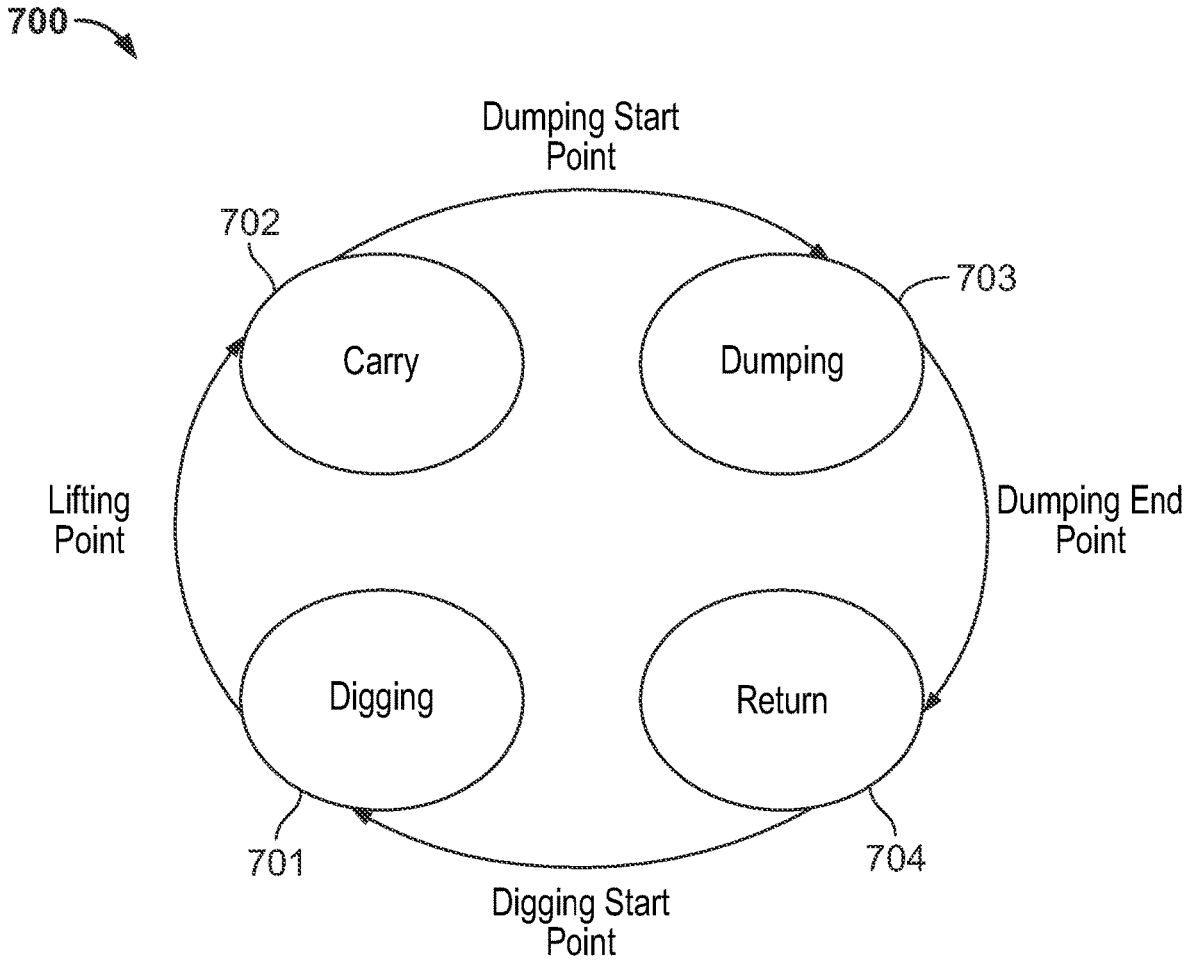
FIG. 7 is a diagram of controller states of an excavator according to an embodiment.

FIG. 7 is a diagram 700 of controller states of an excavator according to an embodiment. In an exemplary embodiment, four controller states are used: digging 701, carry 702, dumping 703 and return 704.

In digging state, an operator manually controls the excavator boom, stick, and bucket to extract material from the ground, using excavator control arms. This process is not automated by a control system because of various complex factors, including load control, risk of rollover, and the non-formalized process of clearing objects in the ground. Additionally, operator fatigue is often not caused from digging, but mostly from a monotonous carry process, which needs to be performed quickly with simultaneous control of four degrees of freedom. However, in an embodiment, overcut protection can be performed by the control system in a digging state. Overcut protection prevents the excavator from digging below a desired design surface by stopping or raising the boom so that the bucket does not travel below the desired design surface. This avoids any time-consuming restoration of the design surface after an undesired overcut. For overcut protection, the desired design surface may be transmitted from a user interface device connected to the controller unit.

In carry state 702, the controller commands the excavator to automatically swing to the dumping start position, keeping a bucket angle in a position that prevents the held material from dropping.

In dumping state 703, the controller commands the bucket to curl out and dump the held material.

In return state 704, the controller commands the excavator to automatically return to a digging start position.

At each time epoch, the controller state is determined from the excavator state vector, the lifting point and the dumping start point.

Figure 8:
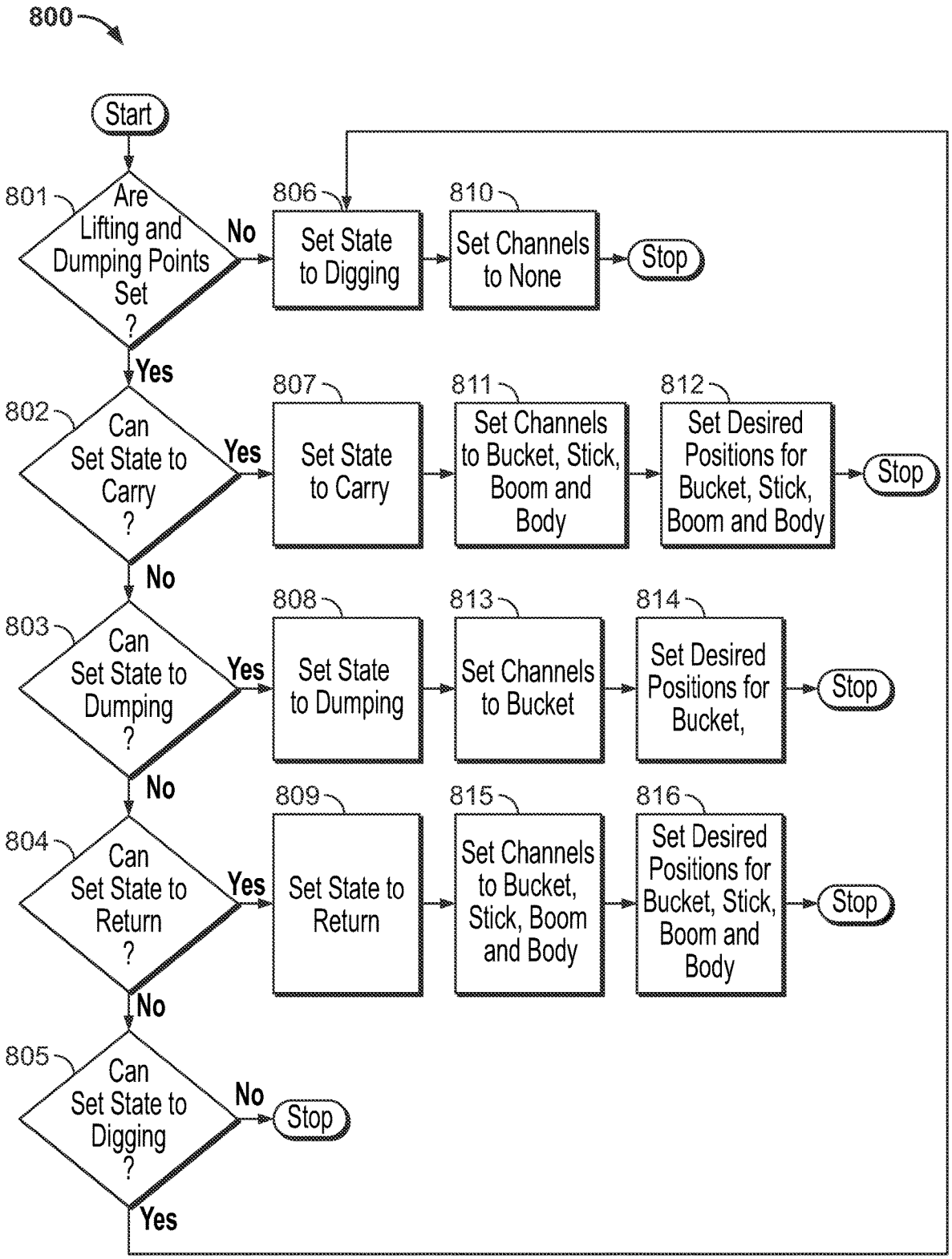
FIG. 8 is a flowchart of a path planner update algorithm according to an embodiment.

FIG. 8 is a flowchart of a path planner update algorithm 800 according to an embodiment.

At step 801, it is determined if a dumping start point or a lifting point have been set during the path recorder update. If a dumping start point is not set, or a lifting point is not set, the controller state is set to digging at step 806.

At step 802, it is determined if the state can be set to carry. If the state is digging and a stick to bucket joint height is greater than a predefined threshold, the state is set to carry at step 807. Additionally, if the state is determined to be digging and a new lifting point was set during path recorder update step in the current time epoch, the state is also set to carry at step 807.

At step 803, it is determined if the state can be set to dumping. If the state is carry and a dumping start position is reached, the state is set to dumping at step 808. If the controller state is carry and a new dumping start point was set during path recorder update in the current time epoch, the state is set to dumping at step 808. To determine if the dumping start position is reached, an absolute value of the vector difference between the current excavator state vector and a dumping start point state vector is calculated, and if it is lower than a predefined threshold, it is determined that a dumping start position has been reached.

At step 804, it is determined if the state can be set to return. If the state is dumping and the material has been dumped, the state is set to return at step 809. To determine if the material has been dumped, an absolute value of a difference between a bucket angle and a predefined dumping end bucket angle is calculated, and if the value is lower than a predefined threshold, the material is determined to have been dumped. In another embodiment, measurements from pressure sensors, connected to main hydraulic lines, are used for determining if the material has been dumped.

At step 805, it is determined if the state can be set to digging. If the state is return and digging start position is reached, the state is set to digging at step 806. If the state is return and a stick to bucket joint height is lower than a predefined value, the state is set to digging at step 806. To determine if a digging start position is reached, an absolute value of vector difference between excavator state vector and lifting point state vector, excluding bucket angle, is calculated, and an absolute value of difference between a predefined bucket attack angle and a current bucket angle is calculated. If the value is lower than predefined thresholds, it is determined that a digging start position has been reached.

When a controller state is changed, the following additional steps are performed: setting of a target or desired position for the controller and specifying which elements of the excavator need to be commanded by the controller. In an embodiment, the following algorithm is used.

In a digging state no channels are commanded by the controller. This setting is performed at step 810.

At step 811 in a carry state, bucket, stick, boom and body rotation channels are set to be commanded by the controller. At step 812, desired positions for the stick, boom, and body rotation are taken from the dumping start point, and a desired position for the bucket is predefined as a bucket hold angle 301 to keep material in the bucket during movement.

At step 813 in a dumping state, the bucket channel is set to be commanded by the controller. At step 814, a desired position for the bucket is set to a bucket dumping end angle 302 to drop and release the held material.

At step 815 in a return state, bucket, stick, boom and body rotation channels are set to be commanded by the controller. At step 816, desired position for stick, boom and body rotation are taken from lifting point, and desired position for bucket is set to a predefined bucket attack angle 303, which is a comfortable position for digging by operator.

Returning back to FIG. 5, controller update 504 is the fourth step of the control algorithm executed at each discrete time epoch. In an embodiment, the excavator state vector, desired position, and list of channels to command determined at the path planner update step are inputs to the controller.

In another embodiment, measurements from pressure sensors, e.g., connected to main hydraulic lines, are other inputs of the controller. Main hydraulic lines pressure measurements are used for local closed loop control, detection of hydraulic cylinder stop, and detection of material dumping.

In yet another embodiment, measurements from pressure sensors, e.g., connected to pilot hydraulic lines, are other inputs of the controller. These pressure sensor measurements are used to determine if an operator is overriding automatic control. When an operator turns a control arm, a pressure in a corresponding pilot line changes, and this pressure change is detected by a corresponding pressure sensor. When such a pressure change is detected, a decision about operator intervention is determined by the controller unit, and corresponding actions are taken, e.g., control signals are set to zero and the controller state is set to digging. Another example of a corresponding action is the correction of a desired position along the axis controlled by an operator.

In yet another embodiment, a user interface device or a switch are used by an operator to interrupt automatic operation of the excavator and a switch to manual operation is performed.

In yet another embodiment, a collision avoidance system is used to interrupt automatic operation and switch to manual operation.

Figure 9:
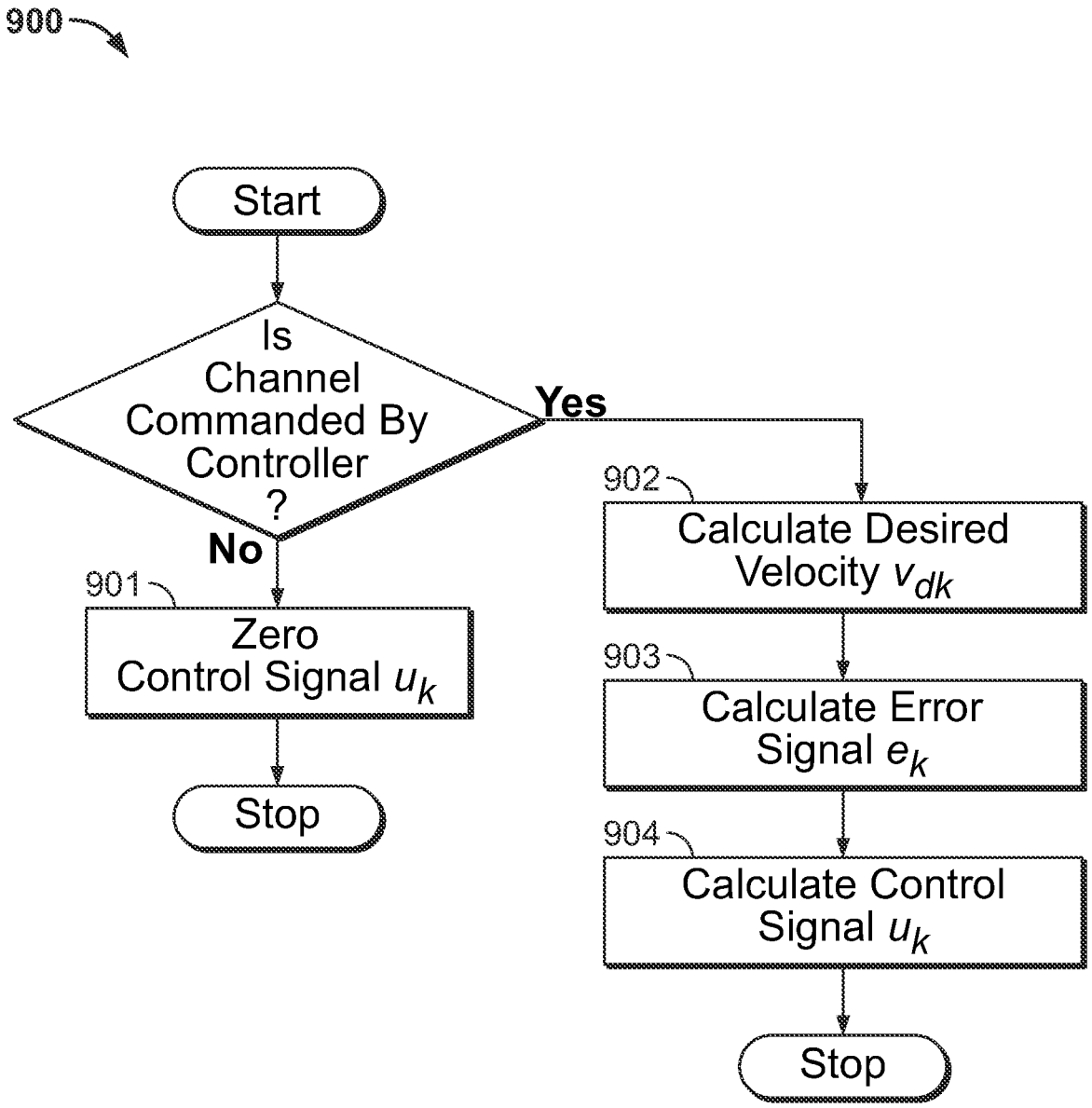
FIG. 9 is a flowchart of a controller update algorithm according to an embodiment.

FIG. 9 is a flowchart of a controller update algorithm according to an embodiment. The controller is configured to calculate a desired control signal for each of a plurality of control channels.

If a channel is not commanded by the controller, a control signal for the channel is set to zero at step 901. Otherwise, a desired velocity is calculated at step 902, an error signal is calculated at step 903, and a control signal for the channel is calculated at step 904.

As described herein, velocity v is a rate of changing of some coordinate x, and position x is a value of this coordinate. In an embodiment of the invention, velocity v is an angular velocity, for example heading angular velocity $\omega_\psi$ of body heading $\psi$ change, and position x is an angle, for example body heading $\psi$.

At step 902, desired velocity $v_{dk}$ for the channel k is calculated from a predefined maximum velocity $v_{maxk}$, desired position $x_{dk}$, and current position $x_{ck}$ of the channel. If an absolute value of the difference between desired position and current position $|x_{dk}-x_{ck}|$ is greater than a predefined value $\Delta x_{maxk}$, desired velocity $v_{dk}$ is set to maximum velocity $v_{maxk}$. If the difference between desired position and current position $x_{dk}-x_{ck}$ is negative, desired velocity $v_{dk}$ is multiplied by −1, so that sign of the desired velocity is equal to sign of the difference between desired position and current position. If the absolute value of the difference between desired position and current position $|x_{dk}-x_{ck}|$ is lower than the predefined value $\Delta x_{maxk}$, desired velocity is multiplied by the absolute value of the difference between desired position and current position divided by the predefined value: $|x_{dk}-x_{ck}|/\Delta x_{maxk}$, so that desired velocity is proportional to the difference between desired position and current position. If current position is near desired position, that is the absolute value of the difference between desired position and current position is lower than a small predefined value $\Delta x_{mink}$, desired velocity is set to zero. In other embodiments of the invention, other algorithms of calculating the desired velocity can be used, or the step of calculating of the desired velocity can be omitted and error and control signals can be calculated directly from current and desired positions.

At step 903, error signal $e_k$ for the channel k is calculated as a difference between desired velocity $v_{dk}$ and current velocity $v_{ck}$ of the channel, taken from excavator state vector.

At step 904, control signal $u_k$ for the channel k is calculated. The error signal $e_k$ is multiplied by the predefined proportional gain $K_{pk}$, resulting in proportional control signal $u_{pk}$. The error signal is then added to a cumulative sum of the error signals from the previous steps. This cumulative sum is multiplied by the predefined integral gain $K_{ik}$, resulting in integral control signal $u_{ik}$. Control signal $u_k$ is then calculated as the sum of proportional control signal $u_{pk}$ and integral control signal $u_{ik}$. Control signal $u_k$ is then limited by the predefined maximum and minimum values and is transmitted to the actuator of corresponding control channel.

In other embodiments of the invention, other methods for calculating error signal $e_k$ and control signal $u_k$ can be used for each channel k. For example, nonlinearity compensation algorithm can be applied to calculation of control signal $u_k$ to compensate actuator nonlinearities like dead zone and hysteresis.

The final step of control algorithm is waiting for the next discrete time epoch 505. In an embodiment of the present disclosure, a timer, provided by an operation system of controller device, is used for determining a moment of the next time epoch. At the moment of the next discrete time epoch, control algorithms steps are repeated.

Systems, apparatuses, and methods described herein may be implemented using digital circuitry, or using one or more computers using well-known computer processors, memory units, storage devices, computer software, and other components. Typically, a computer includes a processor for executing instructions and one or more memories for storing instructions and data. A computer may also include, or be coupled to, one or more mass storage devices, such as one or more magnetic disks, internal hard disks and removable disks, magneto-optical disks, optical disks, etc.

Systems, apparatus, and methods described herein may be implemented using a computer program product tangibly embodied in an information carrier, e.g., in a non-transitory machine-readable storage device, for execution by a programmable processor; and the method and workflow steps described herein, including one or more of the steps or functions of FIGS. 3, 5-6, and 8-9, may be implemented using one or more computer programs that are executable by such a processor. A computer program is a set of computer program instructions that can be used, directly or indirectly, in a computer to perform a certain activity or bring about a certain result. A computer program can be written in any form of programming language, including compiled or interpreted languages, and it can be deployed in any form, including as a stand-alone program or as a module, component, subroutine, or other unit suitable for use in a computing environment.

Figure 10:
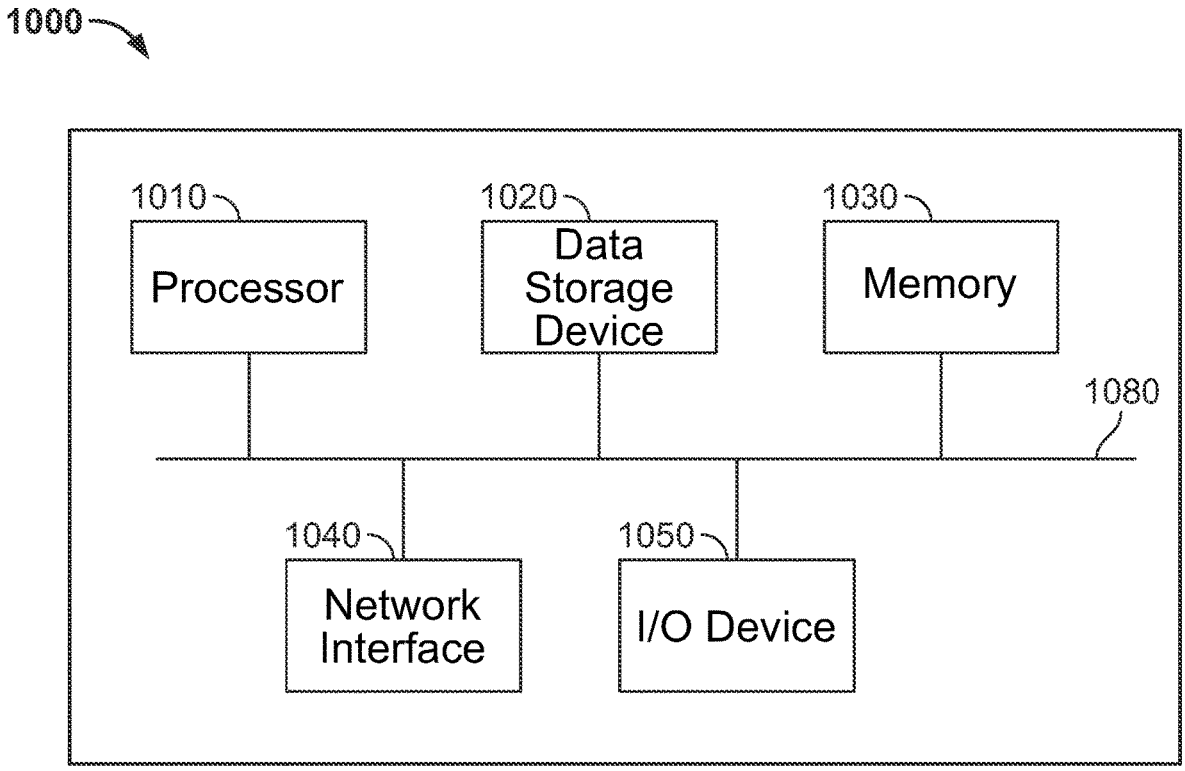
FIG. 10 is a schematic diagram of a computer according to an embodiment.

A high-level block diagram of an example computer 1000 that may be used to implement systems, apparatus, and methods described herein, e.g., the controller unit 407 of FIG. 4 and controller unit 510 of FIG. 5, is depicted in FIG. 10. Computer 1000 includes a processor 1010 operatively coupled to a data storage device 1020 and a memory 1030. Processor 1010 controls the overall operation of computer 1000 by executing computer program instructions that define such operations. The computer program instructions may be stored in data storage device 1020, or other computer readable medium, and loaded into memory 1030 when execution of the computer program instructions is desired. Thus, the method and workflow steps or functions of FIGS. 3, 5-6, and 8-9, can be defined by the computer program instructions stored in memory 1030 and/or data storage device 1020 and controlled by processor 1010 executing the computer program instructions. For example, the computer program instructions can be implemented as computer executable code programmed by one skilled in the art to perform the method and workflow steps or functions of FIGS. 3, 5-6, and 8-9. Accordingly, by executing the computer program instructions, the processor 1010 executes the method and workflow steps or functions of FIGS. 3, 5-6, and 8-9. Computer 1000 may also include one or more network interfaces 1040 for communicating with other devices via a network. Computer 1000 may also include one or more input/output devices 1050 that enable user interaction with computer 1000 (e.g., display, keyboard, mouse, speakers, buttons, etc.). The elements of the computer 1000 may be operably connected via a bus 1080.

Processor 1010 may include both general and special purpose microprocessors, and may be the sole processor or one of multiple processors of computer 1000. Processor 1010 may include one or more central processing units (CPUs), for example. Processor 1010, data storage device 1020, and/or memory 1030 may include, be supplemented by, or incorporated in, one or more application-specific integrated circuits (ASICs) and/or one or more field programmable gate arrays (FPGAs).

Data storage device 1020 and memory 1030 each include a tangible non-transitory computer readable storage medium. Data storage device 1020, and memory 1030, may each include high-speed random access memory, such as dynamic random access memory (DRAM), static random access memory (SRAM), double data rate synchronous dynamic random access memory (DDR RAM), or other random access solid state memory devices, and may include non-volatile memory, such as one or more magnetic disk storage devices such as internal hard disks and removable disks, magneto-optical disk storage devices, optical disk storage devices, flash memory devices, semiconductor memory devices, such as erasable programmable read-only memory (EPROM), electrically erasable programmable read-only memory (EEPROM), compact disc read-only memory (CD-ROM), digital versatile disc read-only memory (DVD-ROM) disks, or other non-volatile solid state storage devices.

Any or all of the systems and apparatus discussed herein, including elements of controller unit 407 of FIG. 4 and controller unit 510 of FIG. 5, may be implemented using one or more computers such as computer 1000.

One skilled in the art will recognize that an implementation of an actual computer or computer system may have other structures and may contain other components as well, and that FIG. 10 is a high level representation of some of the components of such a computer for illustrative purposes.

The foregoing Detailed Description is to be understood as being in every respect illustrative and exemplary, but not restrictive, and the scope of the inventive concept disclosed herein is not to be determined from the Detailed Description, but rather from the claims as interpreted according to the full breadth permitted by the patent laws. It is to be understood that the embodiments shown and described herein are only illustrative of the principles of the inventive concept and that various modifications may be implemented by those skilled in the art without departing from the scope and spirit of the inventive concept. Those skilled in the art could implement various other feature combinations without departing from the scope and spirit of the inventive concept.

The invention claimed is:

1. A method for automatically controlling cyclical operations of an earthmoving machine comprising a plurality of machine elements each controlled by one or more respective actuators, the method comprising:

determining a current machine state;

calculating control signals for at least one actuator when the current machine state corresponds to a cyclical operation;

transmitting the control signals to the at least one actuator to automatically control the cyclical operation;

updating the current machine state based on a current machine position in a coordinate system connected to Earth;

recording a path of the plurality of machine elements of the earthmoving machine during the cyclical operation;

updating a dumping start point when the current machine state corresponds to a dumping start position by comparing components of a state vector with predefined thresholds, wherein the state vector comprises the current machine position and a velocity of the machine; and determining a target based on the recorded path and the current machine state.

2. The method of claim 1, further comprising:

repeating the steps of updating the current machine state, recording a path, and determining a target.

3. The method of claim 1, wherein the current machine state corresponds to a cyclical operation when a complex operation has been completed.

4. The method of claim 1, further comprising:

granting manual control to an operator when the current machine state corresponds to a complex operation.

5. The method of claim 4, wherein a machine state corresponding to a complex operation includes a digging state and lifting, wherein the digging state further comprises overcut protection that prevents the earthmoving machine from digging below a desired surface.

6. The method of claim 1, wherein a machine state corresponding to a cyclical operation includes carrying, dumping, and returning.

7. The method of claim 6, wherein the control signals cause the at least one actuator to swing the earthmoving machine to a dumping start point when the current machine state is determined to be carrying.

8. The method of claim 6, wherein the control signals cause the at least one actuator to curl out a bucket of the earthmoving machine to dump material when the current machine state is determined to be dumping.

9. The method of claim 6, wherein the control signals cause the at least one actuator to return to a digging start point when the current machine state is determined to be returning.

10. The method of claim 1, further comprising:

updating a lifting point when the current machine state corresponds to a lifting position; and wherein determining the current machine state is further based on the dumping start point and the lifting point.

11. The method of claim 10, further comprising:

granting an operator manual control to manually update the cyclical operation.

12. The method of claim 11, wherein manually updating the cyclical operation includes manually updating a dumping start point or manually updated a lifting point.

13. The method of claim 1, wherein the current machine state is determined based on inputs from sensors configured to detect a position and a velocity of each of the plurality of machine elements.

14. The method of claim 1, wherein the earthmoving machine is an excavator, and the plurality of machine elements includes a body, a boom, a stick, and a bucket.

15. The method of claim 1, further comprising:

receiving measurements from one or more pressure sensors, and determining if an operator of the earthmoving machine is overriding the at least one actuator automatically controlling the cyclical operation based on the received measurements.

16. The method of claim 1, wherein updating the current machine state further comprises updating an estimated state vector of the machine based on the current machine position.

17. A method for automatically controlling cyclical operations of an earthmoving machine comprising a plurality of machine elements each controlled by one or more respective actuators, the method comprising:

updating a current machine state based on a current machine position in a coordinate system connected to Earth;

recording a path of the plurality of machine elements of the earthmoving machine during a cyclical operation;

updating a dumping start point when the current machine state corresponds to a dumping start position by comparing components of a state vector with predefined thresholds, wherein the state vector comprises the current machine position and a velocity of the machine;

determining a target based on the recorded path and the current machine state; and calculating control signals for at least one actuator based on the target and recorded path, wherein the calculated control signals for the at least one actuator causing the at least one actuator to move a machine element of the earthmoving machine.

18. The method of claim 17, further comprising:

repeating the steps of updating the current machine state, recording a path, and determining a target.

19. The method of claim 17, further comprising:

granting an operator manual control to manually update the cyclical operation.

20. The method of claim 17, further comprising:

receiving measurements from one or more pressure sensors, and determining if an operator of the earthmoving machine is overriding the at least one actuator automatically controlling the cyclical operation based on the received measurements.

21. The method of claim 17, wherein updating the current machine state further comprises updating an estimated state vector of the machine based on the current machine position.

22. An apparatus for controlling cyclical operations of an earthmoving machine comprising a plurality of machine elements each controlled by one or more respective actuators, the apparatus comprising:

a controller comprising a processor and a non-transitory computer readable medium storing computer program instructions, the computer program instructions, when executed by the processor, cause the processor to perform operations comprising:

determining a current machine state;

calculating control signals for at least one actuator when the current machine state corresponds to a cyclical operation;

transmitting the control signals to the at least one actuator to automatically control the cyclical operation;

updating the current machine state based on a current machine position in a coordinate system connected to Earth, after the at least one actuator executes the transmitted control signals;

recording a path of the plurality of machine elements of the earthmoving machine during the cyclical operation;

updating a dumping start point when the current machine state corresponds to a dumping start position by comparing components of a state vector with predefined thresholds, wherein the state vector comprises the current machine position and a velocity of the machine; and determining a target based on the recorded path and the current machine state.

23. The apparatus of claim 22, wherein the current machine state is determined based on inputs from sensors configured to detect a position and velocity of each of the plurality of machine elements.

24. The apparatus of claim 22, wherein the processor is further caused to perform:

receiving measurements from one or more pressure sensors, and determining if an operator of the earthmoving machine is overriding the at least one actuator automatically controlling the cyclical operation based on the received measurements.

25. The apparatus of claim 22, wherein the processor is further caused to perform:

updating the current machine state by updating an estimated state vector of the machine based on the current machine position.

26. An earthmoving machine, comprising:

a plurality of machine elements;

one or more actuators configured to control each of the plurality of machine elements;

one or more sensors configured to detect a position and velocity of each of the plurality of machine elements; and a controller in communication with the one or more sensors and to the one or more actuators, wherein the controller is configured to:

automatically control cyclical operations of the earthmoving machine by transmitting control signals to the actuators based on input from the sensors;

update a current machine state based on a current machine position in a coordinate system connected to Earth;

record a path of the plurality of machine elements of the earthmoving machine during a cyclical operation;

update a dumping start point when the current machine state corresponds to a dumping start position by comparing components of a state vector with predefined thresholds, wherein the state vector comprises the current machine position and a velocity of the machine; and determine a target based on the recorded path and the current machine state.

27. The earthmoving machine of claim 26, wherein the earthmoving machine is an excavator, and the plurality of machine elements include a body, a boom, a stick, and a bucket.

28. The earthmoving machine of claim 26, wherein the controller is further configured to:

calculate control signals for at least one actuator based on the target and recorded path;

receive measurements from one or more pressure sensors, and determine if an operator of the earthmoving machine is overriding the at least one actuator automatically controlling the cyclical operation based on the received measurements.

29. The earthmoving machine of claim 26, wherein the controller is further configured to update the current machine state by updating an estimated state vector of the machine based on the current machine position.

* * * * *